US005566631A

United States Patent [19]

Reinhart et al.

[11] Patent Number: 5,566,631

[45] Date of Patent: Oct. 22, 1996

[54] SHIELD FOR ATTACHMENT TO A PRESSER FOOT

[75] Inventors: Terry L. Reinhart, Findlay; Vaughn J. Piper, Elida, both of Ohio

[73] Assignee: Findlay Industries, Inc., Findlay, Ohio

[21] Appl. No.: 399,226

[22] Filed: May 8, 1995

[51] Int. Cl.[6] ..... D05B 29/06

[52] U.S. Cl. ..... 112/235

[58] Field of Search ..... 112/235, 240, 112/151

[56] References Cited

U.S. PATENT DOCUMENTS

| | | | |
|---|---|---|---|
| 2,699,743 | 8/1955 | Hill | 112/140 |
| 2,948,242 | 8/1960 | Shuman | 112/235 |
| 2,968,267 | 1/1961 | Johnson | 112/235 |
| 3,195,486 | 11/1965 | Egert | 112/139 |
| 3,370,559 | 2/1968 | Longcore | 112/235 |
| 3,858,539 | 3/1975 | Van Amburg | 112/235 |
| 3,875,878 | 6/1975 | Kaminski | 112/116 |
| 5,335,612 | 8/1994 | Cizek et al. | 112/235 X |

FOREIGN PATENT DOCUMENTS

| | | | |
|---|---|---|---|
| 0984158 | 2/1951 | France | 112/235 |

*Primary Examiner*—Peter Nerbun

*Attorney, Agent, or Firm*—Sidney W. Millard; Kremblas, Foster, Millard & Pollick

[57] ABSTRACT

A presser foot includes an upstanding bar for attachment to the lifter shaft of a sewing machine. At its lower end are a pair of sole plates having a gap therebetween to accommodate the reciprocating motion of a needle and thread associated with the sewing machine. Attached to one of the sole plates is a curved, L-shaped shield which curves transversely in front of the gap between the upstream edges of the sole plates. The shield serves to deflect material on the upper surface of workpieces away from the gap and thereby prevents the clogging of the gap between the sole plates during the sewing operation.

4 Claims, 2 Drawing Sheets

SHIELD FOR ATTACHMENT TO A PRESSER FOOT

FIELD OF THE INVENTION

This invention relates to a shield across the upstream gap between the sole plates of a presser foot on a sewing machine.

BACKGROUND OF THE INVENTION

There are literally thousands of inventions relating to unique structures for presser feet and all work satisfactorily in the environment in which they are designed to operate. However, a problem exists which does not appear to have been addressed by the industry. It is that strings, foam rubber, and other types of obstructions are sometimes present on the upper surface of materials to be sewn together and where they project above the upper surface of the material to be sewn, they can be caught in the gap between forwardly projecting sole plates on presser feet.

This invention came about in an industry which sews fabric and plastic covers for automobile seats. During the sewing operation, there are certain parts of the cover which have a thread extension called a "chain off" which extend one to three inches beyond the edge of the material of the seat cover. The "chain off" prevents the unravelling of the sewn area which occurs if the thread extensions are cut off too close to the end of the material. This "chain off" extension of thread often projects above the surfaces to be sewn. When a transversely extending thread pattern is required to sew the edges of two parts of the seat together, the thread extensions tend to tangle in the presser foot.

The factory where this invention was conceived has dozens of employees sewing automobile seat covers together and where the thread extension accidentally becomes entangled in the presser foot and the threaded, reciprocating needle, the machine must be closed down and the apparatus disentangled before sewing can be resumed.

A test was conducted over a period of time and on average each sewing machine did about 100 seats a day. On average, 71 thread tangles occurred in each machine. After the shield of this invention was attached to the presser feet of the machines, the average entanglement was reduced to three per day per worker for an eight hour shift.

In reviewing the subject matter of unique structure for presser feet, a patent to Hill, U.S. Pat. No. 2,699,743, shows a presser foot having a pair of transversely extending gaps in an upstream extension of the presser foot which guides a set of folds to be sewn together at the edge of a fabric panel. The needle reciprocates vertically through a closed loop hole in the presser foot.

A patent to Egert, U.S. Pat. No. 3,195,486, discloses a reciprocating needle operating in a closed loop on the presser foot. A forwardly extending guide 105, 106, 107 serves to guide the elements to be sewn toward the needle area.

A patent to Van Amburg, U.S. Pat. No. 3,858,539, discloses in FIG. 3 a triangular or cone-shaped deflector 24 upstream of a needle which is confined within a closed loop within the presser foot. The triangular-shaped deflector 24 is structured cooperatively with a pair of side channels which serve collectively to guide elements to be sewn in a converging pattern and funneled toward the needle.

A patent to Kaminski, U.S. Pat. No. 3,875,878, looks very much like the invention described herein except that its structure is in a combination which is intended to prevent upward movement of the workpiece from the needle plate, see column 57, lines 27–29. One thing the patent structure shows and describes in relation to the presser foot is a curved side portion 91 which prevents portions of the workpiece from accidentally being pushed into the path of the needle 84, see particularly column 5, lines 3–36 and 38–40. What it does not disclose is a combination of two sole plates with an L-shaped shield attached to the presser foot.

SUMMARY OF THE INVENTION

This invention is concerned with a presser foot having a bifurcated, forwardly extending sole plate where the gap between sole plates is to accommodate a vertically reciprocating needle and thread. The bifurcated sole plates of the presser foot hold the material being sewn against vertical displacement when the needle and thread are drawn upwardly.

As explained above, problems occur when dangling thread extensions of a chain-off lie across the path of the thread pattern. To prevent the accidental dragging of the chain-off into the slot between the two sole plates, a generally L-shaped shield is mounted on one of the sole plates and extends forwardly and then transversely across the gap between the sole plates. This deflects the chain-off or other obstructions from the sewing path if the obstructions are moveable. If they are not moveable, they are usually not a problem which could cause a fouling of the presser foot and needle-thread combination. Accordingly, the tangles necessitating a shut-down of the sewing machine are greatly minimized because of the forwardly extending shield.

As a result of the design of the shield upstream of the sole plates to deflect obstructions, the inside sewing of certain seams on automobile seat covers was made much easier. In the sewing of certain parts of the seat covers, foam rubber is affixed to the inside surface of the seat fabric prior to the time two portions are sewn together. As a result, the presser foot and needle must extend downwardly 2 ½ or 3 inches between a pair of foam rubber mats to reach and sew overlapping fabric. During the course of the sewing with conventional apparatus, the operator is required to manually hold the abutting edges of the foam rubber mats apart so the sewing can be seen by the operator. The shield provided by this invention performs this function and greatly speeds the sewing process. With the shield incorporated as a part of the presser foot, the shield holds the foam rubber faces apart which frees both hands of the operator to guide the workpieces.

Objects of the invention not clear from the above will be fully appreciated upon a review of the drawings and the description of the preferred embodiment which follows.

DETAILED DESCRIPTION OF THE PREFERRED EMBODIMENT

Figure 1:
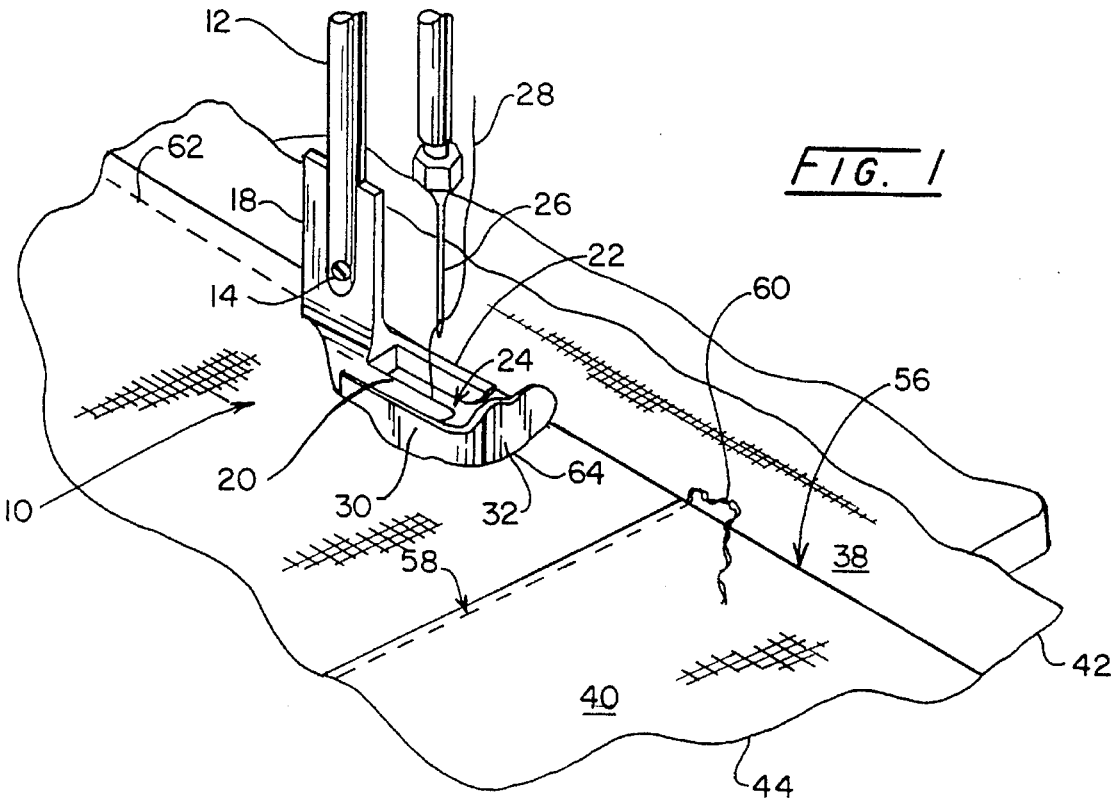
FIG. 1 is a perspective view of the presser foot and shield combination of this invention illustrated as sewing together two abutting fabrics.

FIG. 1 illustrates a presser foot 10 secured to a lifter shift 12 by a screw 14 passing through apertures in the lifter shaft and a hole 16 in the upstanding bar 18 portion of the presser plate.

Attached to the lower end of bar 18 are a pair of sole plates 20, 22 which extend parallel to each other and transversely to the axis of lifter shaft 12. A space or gap 24 between sole plates 20, 22, accommodates a vertically reciprocating needle 26 and thread 28 in conventional fashion during a normal sewing operation.

A generally L-shaped shield 30 is attached to one or the other of the sole plates 20, 22. In the illustrated embodiment, the long leg of the L-shaped shield 30 is attached to sole plate 20 and that is preferred. A transversely extending leg 32 of the shield curves in the generally L-shaped configuration to project in front of the upwardly sloping forward edges of sole plates 20, 22 by a distance of ¼ to ½ inch. Where the distance between leg 32 and the sole plates 20, 22 is too short, obstructions on the upper surface of workpieces are not adequately defliected before the needle 26 advances to the obstruction; where the distance is greater than about ½ inch, a strengthening reinforcement is required to maintain the structural stability of the shield. The ¼ to ½ inch spacing allows the sheet metal shield to operate without embellishments.

In the preferred embodiment, the shield 30 is brazed to the sole plate 20 but it could as easily be formed integral.

It will be observed that the transverse leg 32 of the shield extends completely across gap 24 and beyond the outer edge of sole plate 22 to thereby insure that obstructions in the sewing path are deflected where possible and do not accidentally slide into the gap between the two sole plates. It will further be noted that the lower edges 34, 36 of sole plates 20, 22, respectively, are flat and designed to engage the upper surfaces 38, 40 of workpieces 42, 44, respectively, to hold workpieces 42, 44 against the flat horizontal work plate and needle plate (not shown) in a conventional sewing machine.

Figure 2:
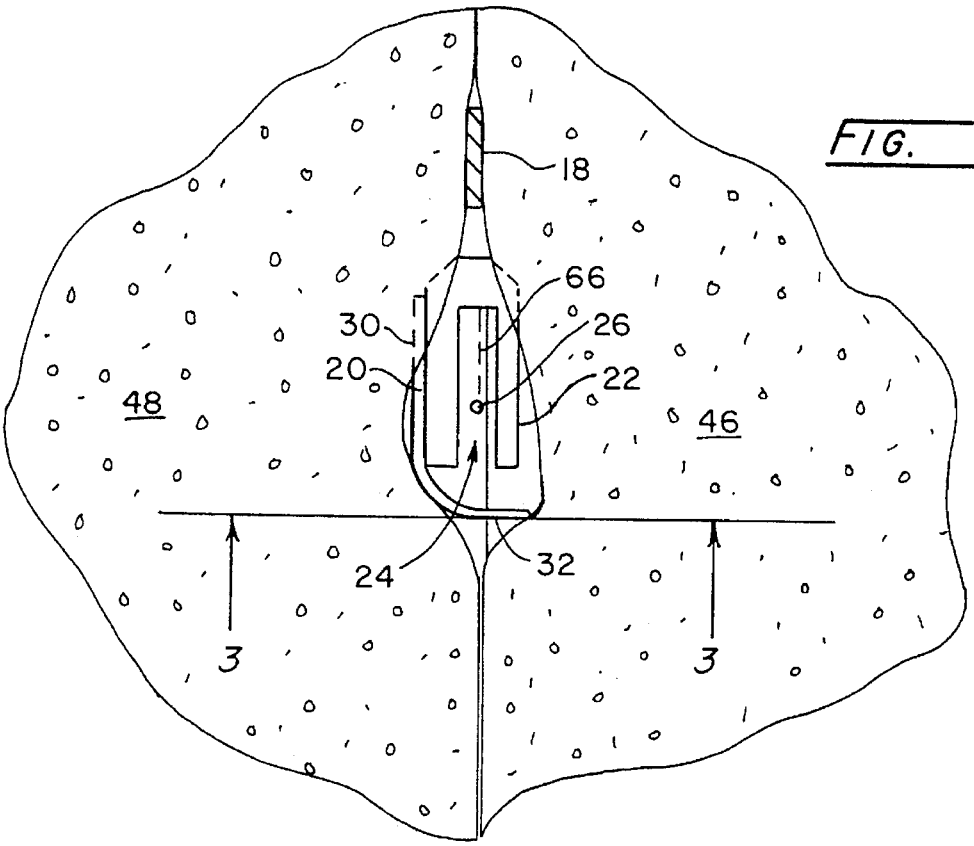
FIG. 2 is a fragmentary top plan view of the presser foot and shield combination of FIG. 1 in an environment involving sewing of workpieces between a pair of abutting foam rubber mats.
Figure 3:
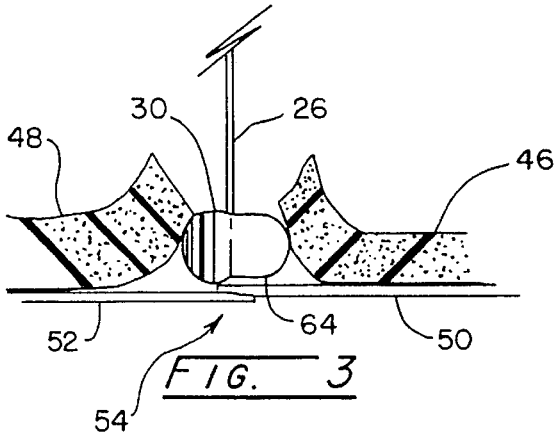
FIG. 3 is a fragmentary sectional view taken along line 3—3 of FIG. 2.
Figure 4:
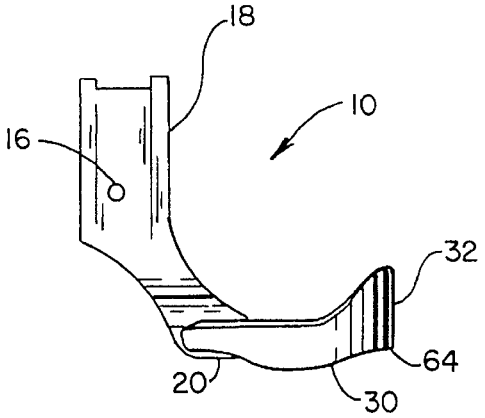
FIG. 4 is a side elevational view of a presser foot having a shield of this invention attached thereto.
Figure 5:
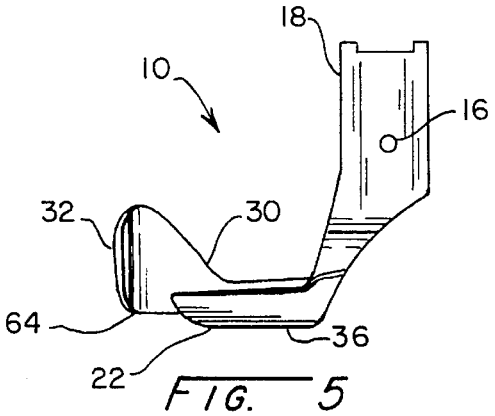
FIG. 5 is a side elevational view of the presser plate and shield combination of FIG. 4 taken from the opposite side.
Figure 6:
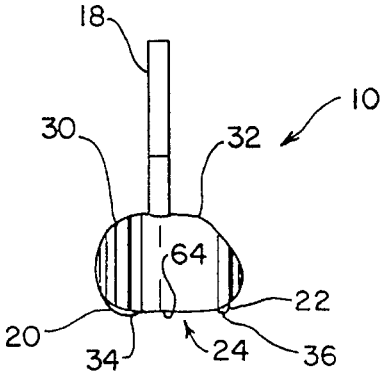
FIG. 6 is a front elevational view of the combination of FIG. 4.
Figure 7:
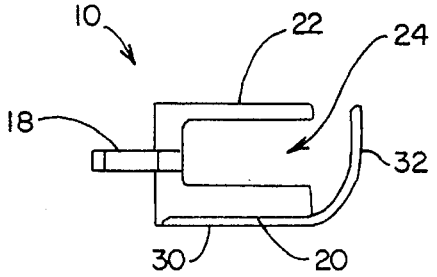
FIG. 7 is a top plan view of the presser foot of FIG. 4.

Looking to FIGS. 2 and 3, it will be observed that foam rubber pads or mats 46, 48 are adhesively or otherwise secured to an inside surface of a workpiece 50, 52, respectively, with the edges of the workpieces overlapping at 54. FIG. 2 illustrates the shield 30 deforming mats 46, 48 by compression to deflect the abutting edges of mats 46, 48 from the work site which allows the operator to use both hands to control the movement of both workpieces rather than having to hold the pads apart during the sewing operation while holding the overlap arena 54 together.

FIG. 3 illustrates an alternative embodiment for the shield where the abutting edges of the foam rubber pads are deflected upward during the sewing operation.

In operation, the lifter shaft 12 has a presser foot 10 mechanically attached thereto by screw 14. It is lowered to the extent that the lower, flat surfaces 34, 36 of sole plates 20, 22 press against the upper surfaces 38, 40 of overlapping workpieces 42, 44. The overlapping edges at 56 are to be sewn together and in the embodiment illustrated in FIG. 1, and consistent with the reason for this invention, it will be noted that workpiece 44 is a series of workpieces sewn together at 58 and having a chain-off or thread extension 60 projecting across the overlapping edge area 56.

As the sewing procedure continues and the seam 62 is advanced, the forward most transversely extending leg 32 of the shield 30 engages the chain-off 60 and deflects it sideways and longitudinally out of the seam area or parallel therewith. It will be observed that the lowermost surface 64 on transversely extending leg 32 is no lower than the lower edges 34, 36 of sole plates 20, 22. This ensures that the sole plates engage the upper surfaces of the workpieces but the lower surface 64 of transversely extending leg 32 will tend to sweep any loose obstruction to one side or the other, more likely the right side in the direction of advance as illustrated in FIG. 1.

Looking to FIGS. 2 and 3, the seam 66 advances in conventional fashion as described previously with the shield 30 and particularly the transversely extending leg 32 serving to push the foam rubber pads 46, 48 out of the operator's viewing area during the sewing operation, thereby allowing the sewing machine operator to better see and better control the sewing operation.

Having thus described the invention in its preferred embodiment, it will be clear to those having ordinary skill in the art, that certain modifications may be made to the apparatus without departing from the spirit of the invention. Accordingly, it is not intended that the invention be limited by the words used to describe the same, nor the drawings illustrating it. Rather it is intended that the invention be limited only by the scope of the appended claims.

We claim:

1. A presser foot and shield combination for attachment to a presser foot lifter shaft on a sewing machine, comprising, a pair of sole plates extending generally perpendicular to a bar, said bar being configured for connection to a lifter shaft, said sole plates being connected to said bar and spaced apart to form a gap to allow the passage of a needle and thread therebetween, said sole plates extending away from said bar and being parallel with each other, said sole plates having lower surfaces lying in the same plane to engage the upper surface of a sewable material, said sole plates terminating in upwardly sloping end remote from said bar, a shield rigidly secured to said presser foot, said shield being of a curved L-shape configuration with one leg of said L-shape extending transversely across said space between said sole plates and at a level below said sloping ends, said transversely extending leg being located remote from said bar and spaced beyond said upward slope of said sole plates, and shield having a lower surface which is not below the elevation of said sole plate lower surfaces, said shield lower surface allows sewable material to pass beneath said shield during sewing operations but is low enough to deflect material above said sewable material away from said space between said sole plates.

2. The presser foot of claim 1 wherein said transversely extending leg of said shield extends completely across said gap and transversely beyond each sole plate.

3. The presser foot of claim 2 wherein said shield is attached to one of said sole plates.

4. The presser foot of claim 1 wherein said shield is attached to one of said sole plates.

* * * * *